US005573127A

United States Patent [19]

Takahashi et al.

[11] Patent Number: 5,573,127

[45] Date of Patent: Nov. 12, 1996

[54] CAP FOR LIQUID CONTAINERS

[75] Inventors: Norio Takahashi; Yukio Ojima, both of Kanagawa-ken, Japan

[73] Assignee: Nifco, Inc., Kanagawa-ken, Japan

[21] Appl. No.: 570,796

[22] Filed: Dec. 12, 1995

[30] Foreign Application Priority Data

May 16, 1995 [JP] Japan ..... 7-142484

[51] Int. Cl.[6] ..... B65D 39/00

[52] U.S. Cl. ..... 215/237; 215/305; 220/264; 220/335; 220/339; 222/153.01; 222/557; 222/562

[58] Field of Search ..... 215/235, 237, 215/238, 305; 220/264, 281, 335, 339; 222/153.01, 557, 562, 563

[56] References Cited

U.S. PATENT DOCUMENTS

| | | | |
|---|---|---|---|
| 4,209,100 | 6/1980 | Uhlig | 215/216 |
| 4,782,964 | 11/1988 | Poore et al. | 215/216 |
| 4,821,898 | 4/1989 | Smalley | 215/216 |
| 4,940,167 | 7/1990 | Fillmore et al. | 222/153 |

FOREIGN PATENT DOCUMENTS 1-66355 6/1989 Japan .

*Primary Examiner*—Stephen Cronin

*Attorney, Agent, or Firm*—Skjerven, Morrill, MacPherson, Franklin & Friel

[57] ABSTRACT

In a container cap, comprising a primary cap provided with an outlet opening in a top wall thereof, and fitted to a mouth of a container, and a secondary cap having an end hinged to the top wall of the primary cap, a slide member slidably overlies an upper surface of the primary cap, and includes a ramp projection projecting vertically therefrom and a lateral projection extending laterally therefrom, and a cover member overlies the slide member. The ramp projection is adapted to move the secondary cap vertically in an opening direction by engaging the secondary cap via the cover member while the lateral projection is adapted to engage an inner surface of the hinge to force the secondary cap in an opening direction. Because the cover member overlies the slide member, the content of the container dripping or spilled from the outlet opening is shielded from the slide member by the cover member. To positively prevent the content from getting into the sliding surfaces of the slide member and to thereby ensure satisfactory operation of the mechanism for opening the secondary cap, preferably, the outlet opening is surrounded by an annular boss, and the cover member is provided with a boot portion closely surrounding the annular boss.

8 Claims, 5 Drawing Sheets

CAP FOR LIQUID CONTAINERS

TECHNICAL FIELD

The present invention relates to a cap for closing an opening of a container for receiving liquid therein, and in particular to a cap which can be opened up with a single action.

BACKGROUND OF THE INVENTION

A cap made of synthetic resin material is often fitted to an opening of a container for liquids such as foods, drugs and cosmetics. The cap often consists of a primary cap having an outlet opening at a top wall thereof, and a secondary cap hinged thereto and adapted to close this outlet opening. For instance, Japanese utility model publication (kokai) No. 1-66355 discloses a container cap including a primary cap and a secondary cap which are joined together by a pair of flexible hinge strips having a reduced thickness, and also by a resilient piece so that the direction of the biasing force of the resilient piece may be reversed from the closing direction to the opening direction and vice versa depending on the angular position of the secondary cap. This utility model publication also discloses a plate member which is slidably guided on the top surface of the primary cap and provided with a tapered surface so as to allow the secondary cap to be opened up with a single hand by inwardly pushing the plate member which in turn pushes up the secondary cap with its tapered surface, the free end of the slide member simultaneously pushing the inner surface of the resilient piece to assist the effort to open the secondary cap.

However, this conventional arrangement involves a highly complex mechanism for opening the secondary cap, and is highly vulnerable to spillage or dripping of the content of the container because the content, which is often highly viscous, could interfere with the satisfactory operation of the sliding member when it gets into the sliding surfaces thereof. In particular, the slide member is provided with a slot through which an annular boss surrounding the outlet opening projects, and this part surrounding the annular boss tends to be soiled from spillage or dripping of the content.

Reference should be made to a copending U.S. patent application which was filed Sep. 6, 1995 (Our ref: F410), the contents of which are hereby incorporated by reference.

BRIEF SUMMARY OF THE INVENTION

In view of such problems of the prior art, a primary object of the present invention is to provide a container cap including a primary cap and a secondary cap joined by a hinge which can be opened up with a single action, and can operate in a reliable fashion.

A second object of the present invention is to provide a container cap which can be opened up with a single action, and can operate satisfactorily even when the content of the container is spilled or drips in the region surrounding the outlet opening.

A third object of the present invention is to provide a container cap which can be opened up with a single action, and can be fabricated and assembled in a simple and economical manner.

These and other objects of the present invention can be accomplished by providing a container cap, comprising: a primary cap provided with an outlet opening in a top wall thereof, and fitted to a mouth of a container; a secondary cap having an end attached to said top wall of said primary cap via a hinge so as to be rotatable around a hinge axis extending substantially perpendicularly to an axial line of said outlet opening between a closing position for closing said outlet opening and an opening position for exposing said outlet opening; a slide member which slidably overlies an upper surface of said primary cap, and includes a ramp projection projecting vertically therefrom and a lateral projection extending laterally therefrom, said lateral projection being adapted to engage an inner surface of said hinge to force said secondary cap in an opening direction; and a cover member which overlies said slide member, and is adapted to move vertically to force said secondary cap in an opening direction when engaged by said ramp projection.

Because the cover member overlies the slide member, the content of the container dripping or spilled from the outlet opening is shielded from the slide member by the cover member. To positively prevent the content from getting into the sliding surfaces of the slide member and to thereby ensure satisfactory operation of the mechanism for opening the secondary cap, preferably, the outlet opening is surrounded by an annular boss, and said cover member is provided with a boot portion closely surrounding said annular boss.

For the cover member to be effective both as an intermediate part for transmitting the actuating force for opening the secondary cap and as a shield for protecting the slide member from the content of the container, said cover member may comprise a fixed part including said boot potion, and a moveable part hinged to said fixed part and adapted to be actuated by said ramp projection into forcing said secondary cap in an opening direction. Alternatively, said cover member may be pivotably supported on said annular boss so as to be pivotable around a pivot axis which is substantially in parallel with said hinge axis of said hinge, and said boot portion is provided with a sufficient flexibility to accommodate a pivoting movement of said cover member while being kept closely placed around said annular boss.

To keep the secondary cap in a fully opened condition when dispensing the content of the container to thereby prevent the secondary cap from interfering with the dispensing of the content, and to assist the effort required to fully close the secondary cap, said hinge preferably consists of a reversing hinge which urges said secondary cap to a closing direction when an opening angle of said secondary cap is less than a certain value, and to an opening direction when the opening angle of said secondary cap is greater than said value.

According to a particularly preferred embodiment of the present invention, the opening of the secondary cap can be made simple and easy by using a push knob which has a lower end attached to said primary cap via a first hinge portion, and an upper end attached to an end of said slide member remote from said lateral projection via a second hinge portion. Thus, by simply pressing the push knob, the secondary cap can be opened. The slide member may be provided with a central slot through which said annular boss projects so as to allow said slide member to be moved laterally across an upper surface of said primary cap without being interfered by said annular boss, and said primary cap may be provided with an internal rib which is adapted to be engaged by said ramp projection by way of said cover member.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
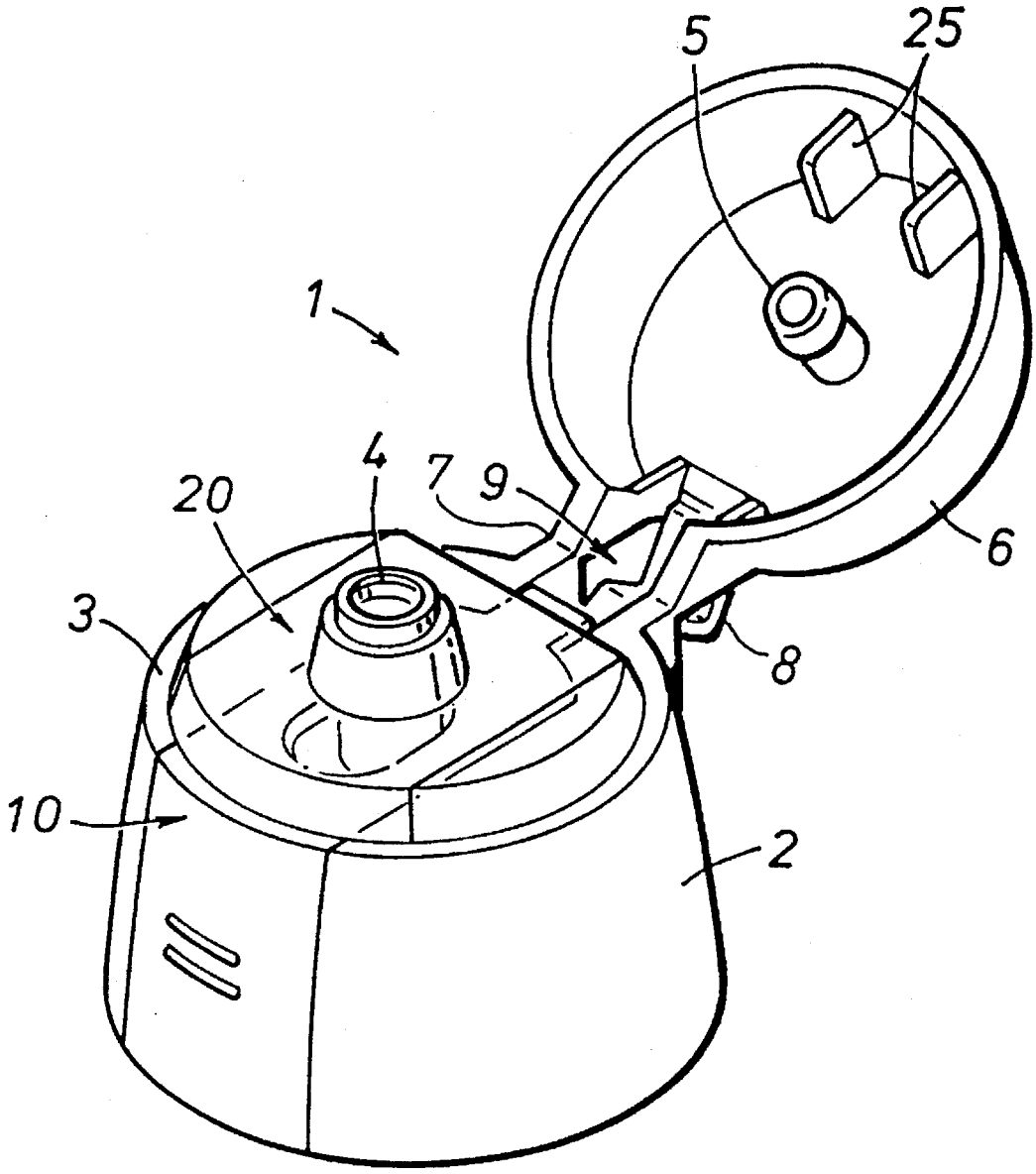
FIG. 1 is a perspective view of a first embodiment of the container cap according to the present invention.
Figure 2:
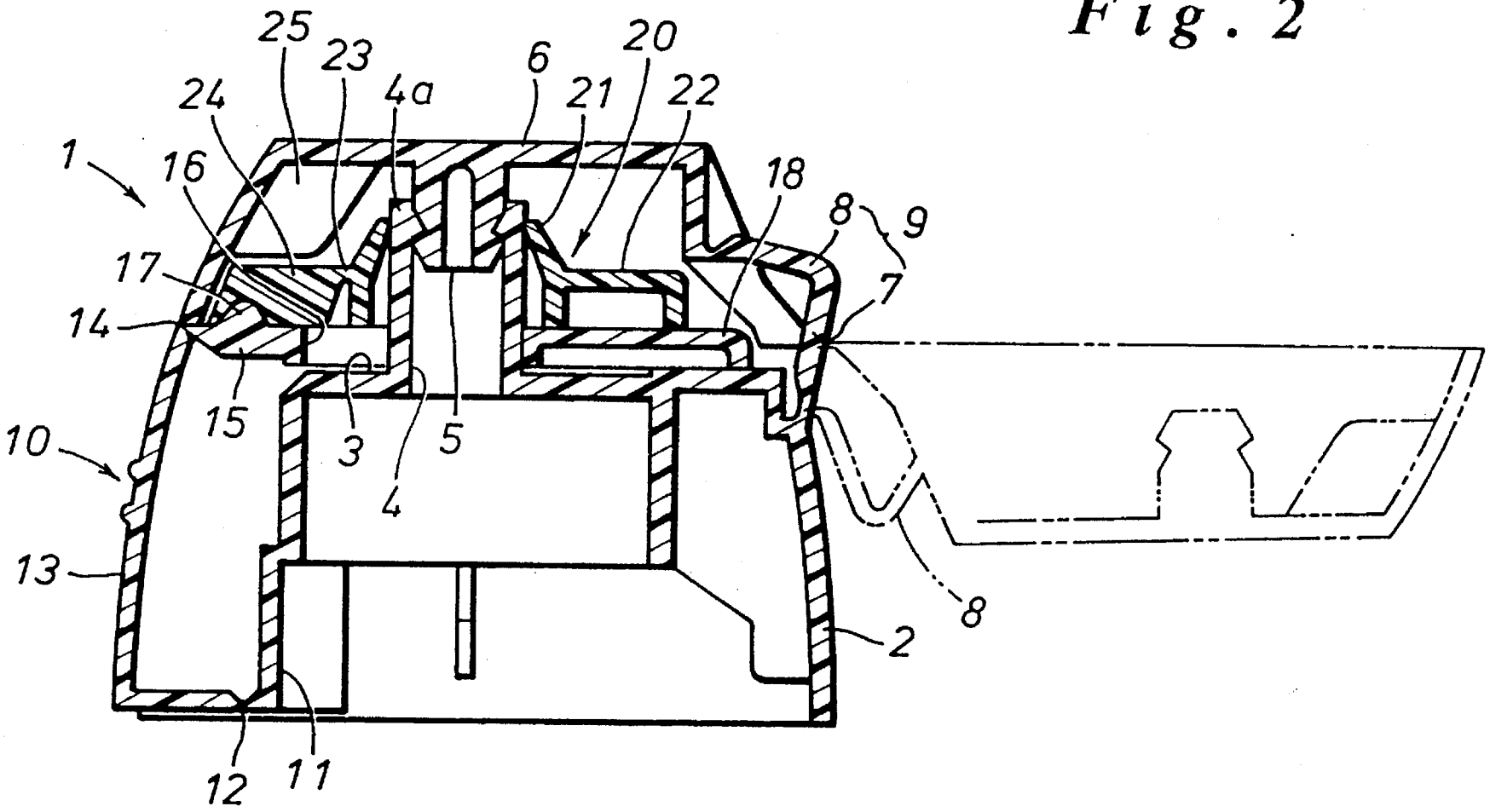
FIG. 2 is a longitudinal sectional view showing the container cap of FIG. 1 when the secondary cap is fully closed.
Figure 3:
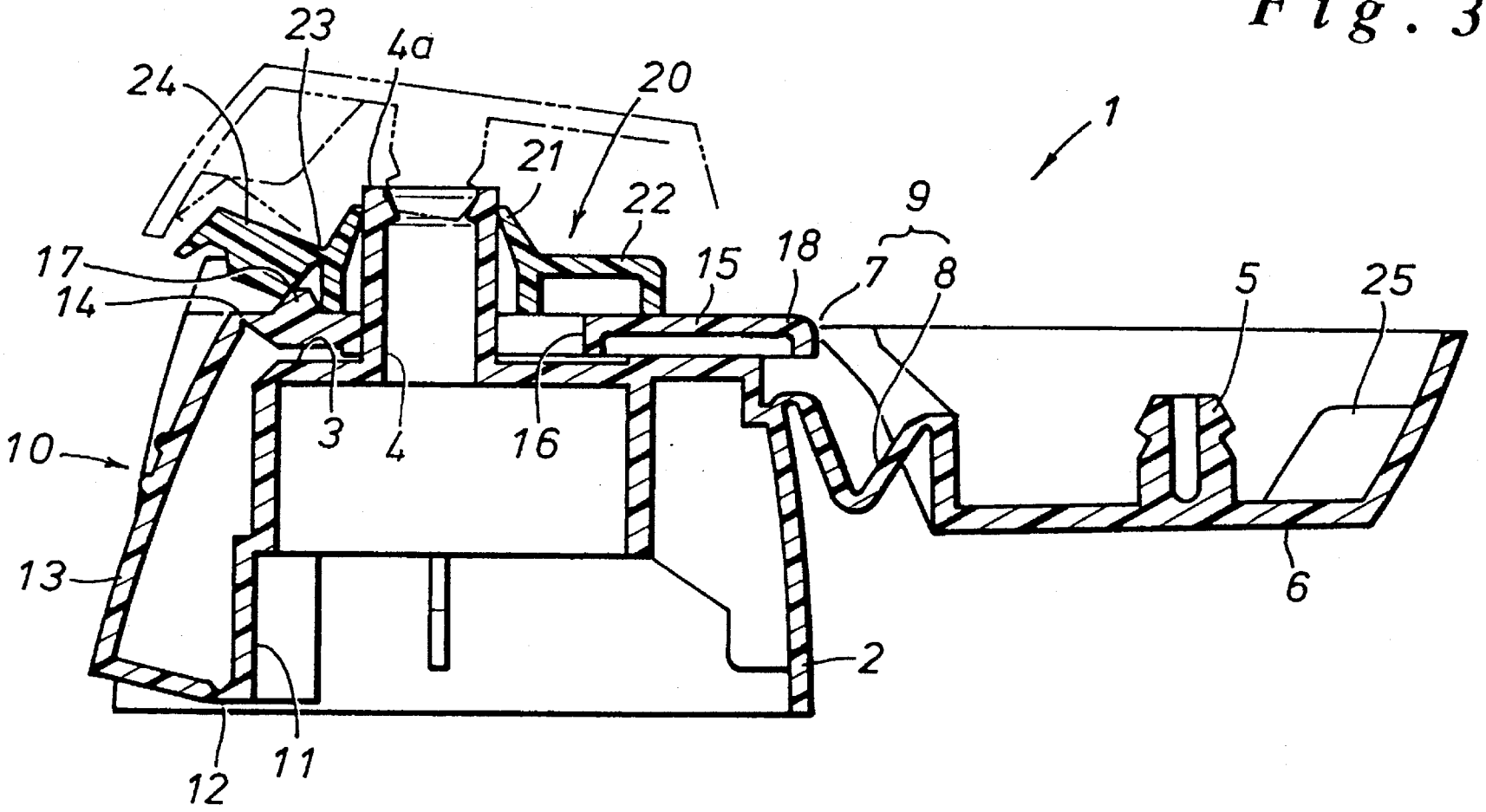
FIG. 3 is a longitudinal sectional view showing the container cap of FIG. 1 when the secondary cap is fully opened.

FIGS. 1 to 3 show an embodiment of the container cap according to the present invention. This cap 1 consists of a primary cap 2 which is substantially cup-shaped and fitted to the mouth of a container main body (not shown in the drawings), and a secondary cap 6 having a plug 5 projecting from an inner surface thereof. The plug 5 is adapted to be fitted into an outlet opening 4 provided in a top wall 3 of the primary cap 2. The primary cap 2 and the secondary cap 6 may be integrally molded from synthetic resin material such as polypropylene having a sufficient resiliency.

The primary cap 2 and the secondary cap 6 are joined together by a reversing hinge 9 consisting of a pair of hinge portions 7 and a resilient strip 8 flanked by the hinge portions 7. The hinge portions 7 provide a normal hinge action for the secondary cap 6, and the resilient strip 8 urges the secondary cap 6 to a closing direction when the opening angle of the secondary cap 6 is less than a certain value, and in an opening direction when the opening angle of the secondary cap 6 is greater than this value.

The primary cap 2 is integrally provided with a push opener 10 which consists of a push knob 13 attached, at a lower end thereof, to a lower portion of a side wall 11 of the primary cap 2 via a hinge portion 12, and a slide portion 13 which is attached to an upper end of the push knob 13 via a hinge portion 14. The slide portion 13 overlies the upper surface of the top wall 3 of the primary cap 2, and is centrally provided with a slot 16 through which an annular boss **4*a* surrounding the outlet opening 4 projects. Thus, the slide portion 13 can slide over the upper surface of the top wall 3 of the primary cap 2 without being interfered by the annular boss 4*a*. A ramp projection 17 is provided on a part of the upper surface of the slide portion 13 adjacent to the hinge portion 14 for pushing up a cover member 20 as described hereinafter, and the other end of the slide portion 13 is provided with a lateral projection 18 for pushing the resilient piece 8** as described hereinafter.

The cover member 20 overlies the upper surface of the slide portion 15. The cover member 20 is made of resilient synthetic resin material, and consists of a fixed portion 22 provided with a boot portion 21 closely surrounding the outlet opening boss **4*a*, and a moveable portion 24 attached to the fixed portion 22 via a hinge portion 23. The fixed portion 22 is fixed in position by being fitted onto the outlet opening boss 4*a* while the moveable portion 24 can be vertically tilted around the hinge portion 23**.

The inner surface of the secondary cap 6 is provided with the plug 6 which is adapted to fit into the outlet opening 4, and a pair of ribs 25 adapted to be engaged by the moveable portion 24 of the cover member 20.

The mode of the operation of this embodiment is now described in the following. When the push knob 13 is pushed inward with the secondary cap 6 closed as illustrated in FIG. 2, the slide portion 15 slides over the upper surface of the primary cap 2, and the ramp projection 17 engages the rib 25 of the secondary cap 6, via the moveable portion 24 of the cover member 20, thereby pushing open the secondary cap 6 as indicated by the imaginary lines in FIG. 3. As a result, the plug 5 is dislodged from the outlet opening 5. The reversing hinge 9 at this point still urges the secondary cap 6 in the closing direction.

As the push knob 13 is further pressed, the lateral projection 18 at the free end of the slide portion 15 pushes the inner surface of the resilient piece 8, thereby pushing the secondary cap 6 open. When the secondary cap 6 is fully open, the resilient piece 8 urges the secondary cap 6 in the opening direction, thereby maintaining the secondary cap 6 in the fully open state even after the lateral projection 18 is disengaged from the resilient piece 8. When the push knob 13 is released, the push knob 13 along with the slide portion 15 returns to their initial positions under the spring forces of the hinge portions 12 and 14.

When the secondary cap 6 is desired to be closed, the secondary cap 6 is rotated around the reversing hinge 9 by using a finger until the plug 5 fits into the outlet opening 4 of the primary cap 2.

Figure 4:
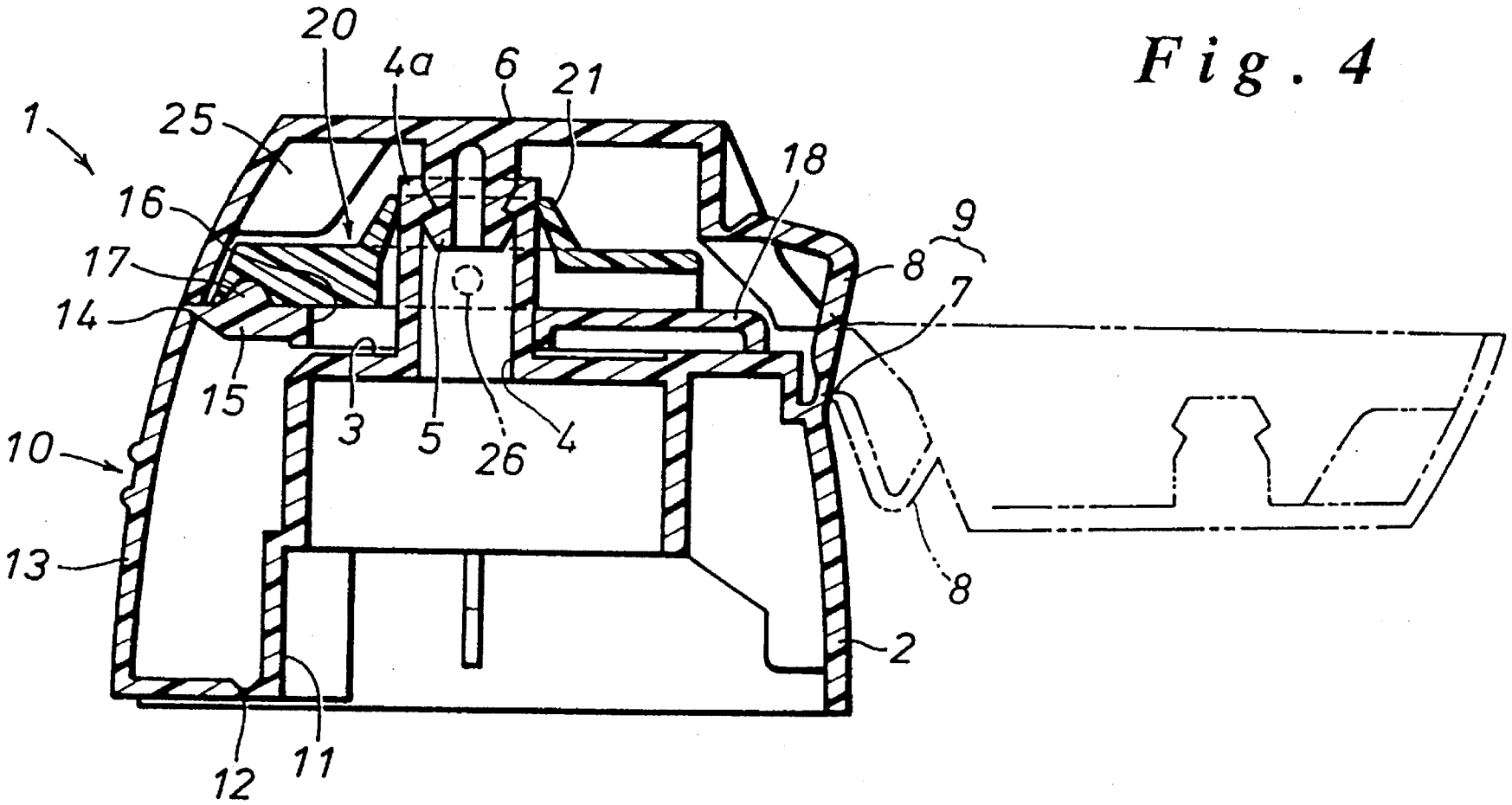
FIG. 4 is a longitudinal sectional view showing a second embodiment of the container cap according to the present invention when the secondary cap is fully closed.
Figure 5:
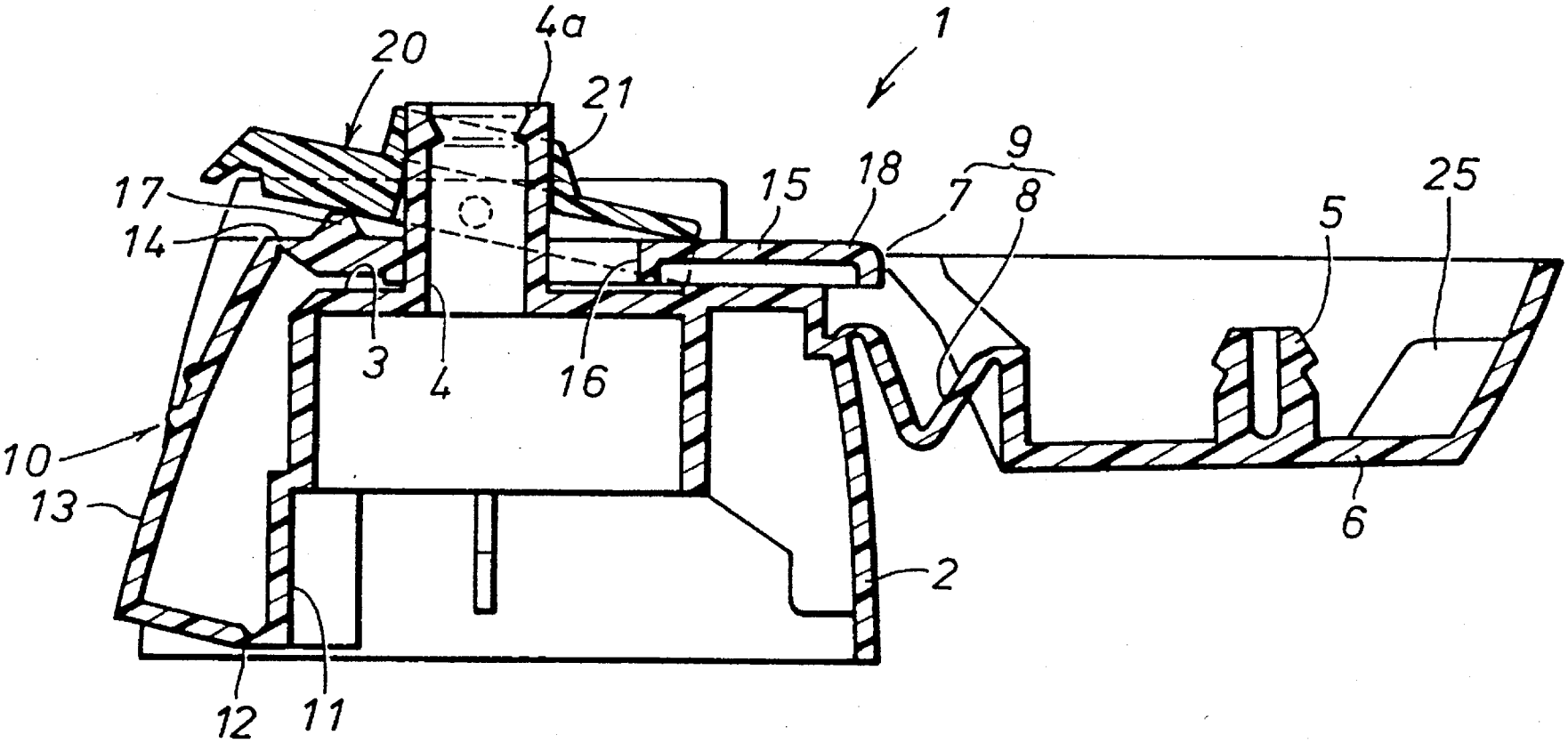
FIG. 5 is a longitudinal sectional view showing the container cap of FIG. 4 when the secondary cap is fully opened.

FIGS. 4 and 5 show a second embodiment of the container cap according to the present invention, and the parts corresponding to those of the previous embodiments are denoted with like numerals. In this embodiment, the cover member 20 is not provided with the hinge portion 23, and is, instead, pivotably supported by a pivot shaft 26 extending radially from the outlet opening boss **4*a* so that the cover member 20 may be capable of a rocking movement around the pivot shaft 26 which extends perpendicularly to the axial line of the outlet opening 4 or in parallel with the hinge axis of the hinge 9. When the slide portion 15 is moved along the upper surface of the primary cap 2, and the ramp projection 17 pushes the lower stirface of the cover member 20, the cover member 20 is entirely tilted in the clockwise direction as seen FIGS. 4 and 5 while the boot portion 21, closely surrounding the outlet opening boss 4*a*, is resiliently deformed so as to accommodate the rocking movement of the cover member 20. Thus, according to this embodiment also, the secondary cap 6 can be opened up in substantially the same way as in the first embodiment as the push knob 13 is pressed, and the resulting rocking movement of the cover member 20 causes the rib 25 of the secondary cap 6** to be pushed upward.

Thus, according to the present invention, the secondary cap can be opened up with a single action. In particular, even when the content drips from the outlet opening, because the outlet opening boss **4*a* is closely surrounded by the boot portion 21 of the cover member, it would not enter the sliding parts of the slide potion 15**. Thus, the present invention provides a container cap which is easy to operate, and can achieve its function in a both satisfactory and reliable manner. Because the entire container cap can be fabricated from a small number of integrally molded plastic components, the fabrication cost can be minimized, and the fabrication process can be simplified.

Although the present invention has been described in terms of preferred embodiments thereof, it is obvious to a person skilled in the art that various alterations and modifications are possible without departing from the scope of the present invention which is set forth in the appended claims.

What we claim is:

1. A container cap, comprising:

a primary cap provided with an outlet opening in a top wall thereof, and fitted to a mouth of a container;

a secondary cap having an end attached to said top wall of said primary cap via a hinge so as to be rotatable around a hinge axis extending substantially perpendicularly to an axial line of said outlet opening between a closing position for closing said outlet opening and an opening position for exposing said outlet opening;

a slide member which slidably overlies an upper surface of said primary cap, and includes a ramp projection projecting vertically therefrom and a lateral projection extending laterally therefrom, said lateral projection being adapted to engage an inner surface of said hinge to force said secondary cap in an opening direction; and a cover member which overlies said slide member, and is adapted to move vertically to force said secondary cap in an opening direction when engaged by said ramp projection.

2. A container cap according to claim 1, wherein said hinge consists of a reversing hinge which urges said secondary cap to a closing direction when an opening angle of said secondary cap is less than a certain value, and to an opening direction when the opening angle of said secondary cap is greater than said value.

3. A container cap according to claim 1, further comprising a push knob having a lower end attached to said primary cap via a first hinge portion, and an upper end attached to an end of said slide member remote from said lateral projection via a second hinge portion.

4. A container cap according to claim 1, wherein said primary cap is provided with an internal rib which is adapted to be engaged by said ramp projection by way of said cover member.

5. A container cap according to claim 1, wherein said outlet opening is surrounded by an annular boss, and said cover member is provided with a boot portion closely surrounding said annular boss.

6. A container cap according to claim 5, wherein said cover member comprises a fixed part including said boot potion, and a moveable part hinged to said fixed part and adapted to be actuated by said ramp projection into forcing said secondary cap in an opening direction.

7. A container cap according to claim 5, wherein said cover member is pivotably supported on said annular boss so as to be pivotable around a pivot axis which is substantially in parallel with said hinge axis of said hinge, and said boot portion is provided with a sufficient flexibility to accommodate a pivoting movement of said cover member while being kept closely placed around said annular boss.

8. A container cap according to claim 5, wherein said slide member is provided with a central slot through which said annular boss projects so as to allow said slide member to be moved laterally across an upper surface of said primary cap without being interfered by said annular boss.

* * * * *